US006933682B2

(12) United States Patent
Ziegler

(10) Patent No.: US 6,933,682 B2
(45) Date of Patent: Aug. 23, 2005

(54) METHOD FOR OPERATING FLUORESCENT LAMPS AND BALLAST

(75) Inventor: Markus Ziegler, Traunwalchen (DE)

(73) Assignee: Patent Trauhand Gesellschaft fur elektrische Gluhlampen mbH, Munich (DE)

( * ) Notice: Subject to any disclaimer, the term of this patent is extended or adjusted under 35 U.S.C. 154(b) by 4 days.

(21) Appl. No.: 10/643,952

(22) Filed: Aug. 20, 2003

(65) Prior Publication Data

US 2004/0051481 A1 Mar. 18, 2004

(30) Foreign Application Priority Data

Aug. 30, 2002 (DE) ..... 102 40 807

(51) Int. Cl.[7] ..... H05B 37/02

(52) U.S. Cl. ..... 315/224; 315/291; 315/307; 315/360

(58) Field of Search ..... 315/224–226, 315/291, 299, 307, 360, DIG. 2, DIG. 4, DIG. 5, DIG. 7

(56) References Cited

U.S. PATENT DOCUMENTS

| | | | | |
|---|---|---|---|---|
| 4,463,287 A | | 7/1984 | Pitel | 315/291 |
| 4,894,587 A | | 1/1990 | Jungreis et al. | 315/200 |
| 5,066,894 A | | 11/1991 | Klier | 315/224 |
| 5,798,620 A | * | 8/1998 | Wacyk et al. | 315/307 |
| 6,040,661 A | * | 3/2000 | Bogdan | 315/224 |
| 6,414,449 B1 | * | 7/2002 | Hui et al. | 315/291 |
| 6,424,100 B1 | * | 7/2002 | Kominami et al. | 315/307 |
| 6,605,905 B2 | * | 8/2003 | Kosa et al. | 315/224 |

FOREIGN PATENT DOCUMENTS

| | | | |
|---|---|---|---|
| EP | 0 287 360 A2 | 10/1988 | H01S/3/133 |
| EP | 0 529 901 A1 | 3/1993 | H05B/41/29 |

OTHER PUBLICATIONS

Copy of Search Report (5 pages) for corresponding European application; search report was issued by the European Patent Office on Jan. 19, 2004.

* cited by examiner

*Primary Examiner*—Thuy V. Tran

(57) ABSTRACT

The invention relates to an operating method for fluorescent lamps and a corresponding ballast, in which the brightness of the fluorescent lamps (LP) is set to the desired value by varying the switching frequency of the inverter switches (T1, T2). In order to prevent oscillations between different operating states in a critical dimming range, the power consumption of the fluorescent lamps (LP) is stabilized according to the invention by way of an additional control loop.

16 Claims, 2 Drawing Sheets

METHOD FOR OPERATING FLUORESCENT LAMPS AND BALLAST

I. TECHNICAL FIELD

Figure 1:
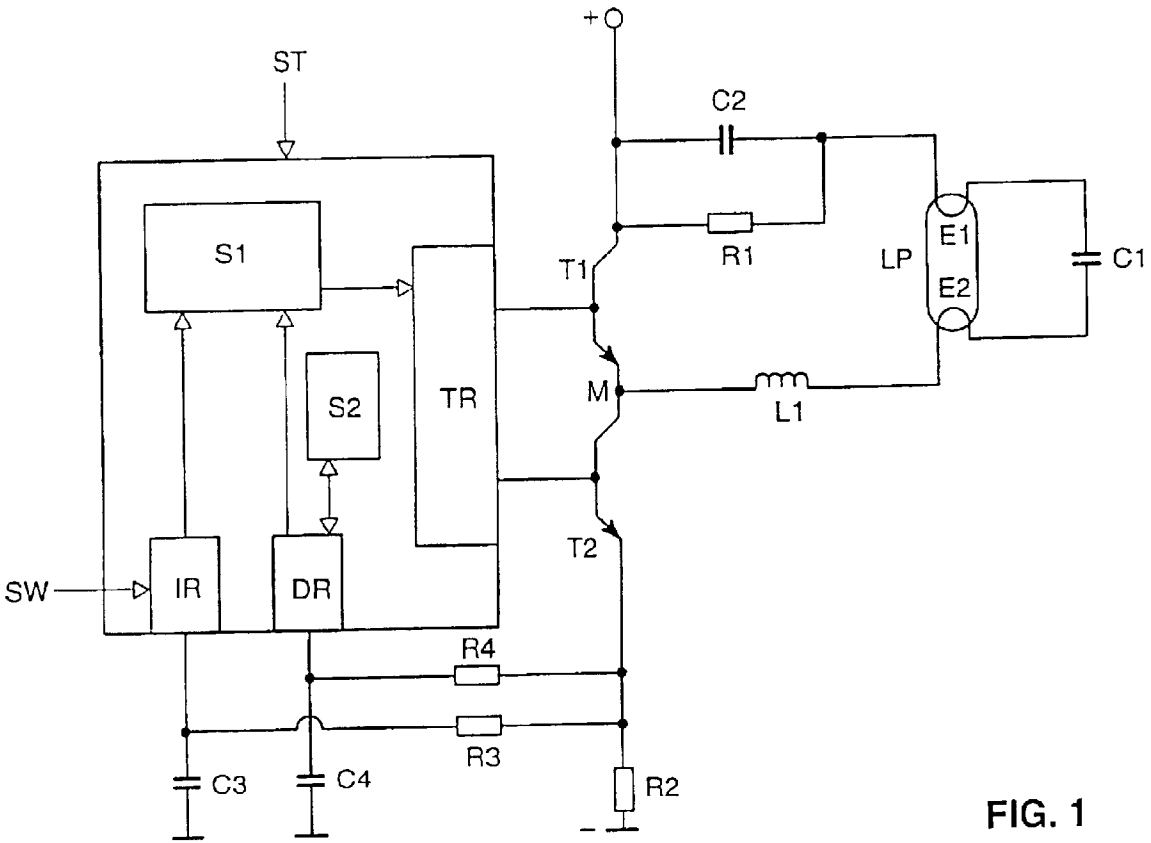

The invention relates to a method for operating fluorescent lamps with the aid of a ballast, which has an inverter having semiconductor switches arranged in a bridge circuit and having a control apparatus for the semiconductor switches, and at least one load circuit which is in the form of a resonant circuit, is connected to the inverter, and in which at least one fluorescent lamp is operated, the inverter applying a radiofrequency current to the at least one fluorescent lamp, and the power consumption of the at least one fluorescent lamp being set to a predeterminable value by means of a first control loop by varying the frequency of the radiofrequency current. Furthermore, the invention relates to a ballast for carrying out the method.

II. BACKGROUND ART

A method of this kind is disclosed, for example, in patent specification EP 0 422 255 B1. This publication discloses an electronic ballast for operating fluorescent lamps which enables the brightness and power of the fluorescent lamps to be regulated by varying the switching frequency of the inverter switches. In order to prevent the fluorescent lamp from extinguishing if brightness is low, i.e. if the lamp is operating at only 1% of the nominal luminous flux, not only the power but also the instantaneous discharge resistance of the fluorescent lamp is monitored and a secondary controlled variable is derived from the discharge resistance, which increases as the brightness of the fluorescent lamp decreases, for controlling the inverter switches.

It has been shown that in the case of fluorescent lamps, fluctuations in the operating state or unstable operating states arise if their luminous flux is regulated by means of the abovedescribed method to approximately 25% to 10% of their nominal luminous flux. The reason for these unstable operating states is a nonlinear dependence of the power consumption of the fluorescent lamp on the frequency of the current generated by the inverter. In an unfavorable case, even the smallest of changes in the switching frequency of the inverter and thus in the frequency of the current flowing through the bridge circuit can cause severe changes in the lamp power in the abovementioned range.

III. DISCLOSURE OF THE INVENTION

It is the object of the invention to propose a method for regulating the power consumption and the brightness of fluorescent lamps in a stable manner.

This object is achieved according to the invention by the features of patent claim 1. Particularly advantageous embodiments of the invention are described in the dependent patent claims.

The method according to the invention for operating fluorescent lamps with the aid of a ballast, which has an inverter having semiconductor switches, which are arranged in a bridge circuit, and having a control apparatus for the semiconductor switches, and at least one load circuit which is in the form of a resonant circuit, is connected to the inverter, and in which at least one fluorescent lamp is operated, the inverter applying a radiofrequency current to the at least one fluorescent lamp, and the power consumption of the at least one fluorescent lamp being set to a predeterminable value by means of a first control loop by varying the frequency of the radiofrequency current, is characterized by the fact that the power consumption of the at least one fluorescent lamp is stabilized at the predeterminable value by means of a second control loop, which is passed through at shorter time intervals than the first control loop. The second control loop ensures that the fluorescent lamps can be operated reliably even in the critical power range, corresponding to approximately 25% to 10% of their nominal luminous flux, without considerable fluctuations in the power consumption or the brightness of the fluorescent lamps occurring. The second control loop is passed through at considerably shorter time intervals than the first control loop and can therefore counteract rapid changes in the power consumption of the fluorescent lamps as may occur in the abovementioned critical range. The time intervals at which the second control loop is passed through are advantageously 50 $\mu$s to 200 $\mu$s, whereas the time intervals at which the first control loop is passed through are considerably longer, at preferably 1 ms to 2 ms.

In the case of the method according to the invention, for the purpose of carrying out the first control loop, a desired value which can be set in terms of its magnitude is advantageously compared at predetermined time intervals with an actual value which is derived from the power consumption, averaged over time, of the at least one fluorescent lamp, and a first manipulated variable for the control apparatus is formed from this actual value, whereas, for the purpose of carrying out the second control loop at predetermined time intervals which are shorter than the time intervals for the first control loop, the change in the power consumption of the at least one fluorescent lamp is evaluated for the purpose of generating a second manipulated variable for the control apparatus, and the two manipulated variables are evaluated in order to generate control signals for regulating the switching frequency of the semiconductor switches. In this manner, it is possible to set, by means of the first control loop, the desired power consumption and brightness for the fluorescent lamps and to prevent, by means of the second control loop, undesirable fluctuations in the power consumption of the fluorescent lamps, in particular in the abovementioned critical operating range. The control variables, both for the first and for the second control loops, are advantageously derived from the current flowing through the bridge circuit, since the average value over time for this current is proportional to the power consumption of the fluorescent lamps. The controlled variables, i.e. the actual values, of the two control loops are derived, for example by means of a low-pass filter, from the current flowing via the bridge circuit, the time constant of the second low-pass filter belonging to the second control loop being smaller than the time constant of the first low-pass filter belonging to the first control loop. The time constants are in each case matched to the abovementioned time intervals of the control loops. The functions of the two low-pass filters are preferably taken on by in each case one digital filter, which operate at different sampling frequencies, matched to the abovementioned time intervals. The use of digital filters simplifies the construction of the circuit arrangement, since they can be formed as part of a microprocessor.

The second control loop is advantageously in the form of a comparison of the desired value and the actual value which is repeated continuously at predetermined time intervals, an actual value being derived from the current flowing through the bridge circuit at the end of each time interval and this actual value being compared with the actual value of the directly preceding time interval acting as the desired value in order to generate the second manipulated variable for the control apparatus of the inverter therefrom.

The ballast according to the invention has an inverter having semiconductor switches which are arranged in a bridge circuit, a control apparatus for the semiconductor switches, and at least one load circuit, which is in the form of a resonant circuit and is connected to the inverter, having terminals for at least one fluorescent lamp, the control apparatus having means for varying the switching frequency of the semiconductor switches in order to set the power consumption of the at least one fluorescent lamp to a predeterminable value, and the control apparatus having means for stabilizing the power consumption of the at least one fluorescent lamp at the predeterminable value.

The means for stabilizing the power consumption of the at least one fluorescent lamp are preferably in the form of a differential-action controller, also known as a D-action controller, which monitors the change in the power consumption of the at least one fluorescent lamp at predetermined time intervals and, as a function of this, generates a manipulated variable for the control apparatus for stabilizing the power consumption at the predeterminable value. In order to set the brightness or the power consumption of the at least one fluorescent lamp to the desired value, the ballast according to the invention preferably has a proportional-plus-integral controller, also known as a PI controller, which is slow in comparison with the D-action controller and compares the power consumption, averaged over time, of the at least one fluorescent lamp with a predeterminable desired value. The two controllers are advantageously formed as part of a microprocessor which is in turn part of the control apparatus. The manipulated variables generated by the two controllers are superimposed and stored in a digital data register of the microprocessor.

IV. BRIEF DESCRIPTION OF THE DRAWINGS

Figure 2:
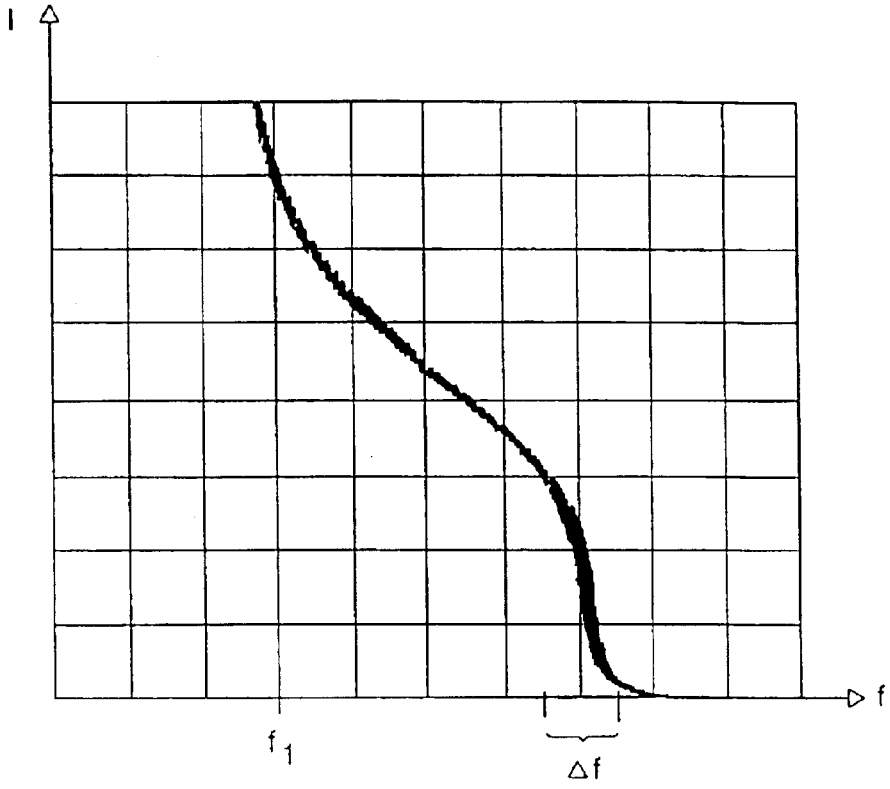

The invention will now be explained in more detail below with reference to a preferred exemplary embodiment. In the drawings:

FIG. 1 shows a schematic representation of the ballast according to the invention, and FIG. 2 shows a schematic representation of the dependence of the half-bridge current on the frequency of the inverter.

V. BEST MODE FOR CARRYING OUT THE INVENTION

FIG. 1 shows a schematic of the construction of an electronic ballast according to the invention for operating a fluorescent lamp. This ballast has a half-bridge inverter having two semiconductor switches, in particular transistors T1, T2, a control apparatus ST for the semiconductor switches T1, T2 and two terminals +, − for the d.c. voltage supply of the half-bridge inverter. A load circuit in the form of a resonant circuit is connected to the central tap M of the half-bridge inverter. The load circuit comprises the resonance inductor L1, the resonance capacitor C1, the coupling capacitor C2, the discharge resistor R1, arranged in parallel with the coupling capacitor C2, and terminals for the electrode filaments E1, E2 of a fluorescent lamp LP. The fluorescent lamp LP is arranged in the load circuit such that its discharge path is connected in parallel with the resonance capacitor C1 and the electrode filaments E1, E2 are connected in series with the resonance capacitor C1. This circuit arrangement is disclosed, for example, in patent specification EP 0 422 255 B1. The semiconductor switches T1, T2 are activated and deactivated alternately by means of the control apparatus ST, with the result that a radiofrequency current having frequencies in the range of approximately 40 kHz to 150 kHz is applied to the load circuit and the lamp LP. The starting voltage required to start the gas discharge in the fluorescent lamp LP is provided by means of the method involving the magnification factor at the resonance capacitor C1. For this purpose, the switching frequency of the semiconductor switches T1, T2 and thus also the frequency of the current in the load circuit is set to a value close the resonant frequency of the resonance components L1, C1. Once the gas discharge in the fluorescent lamp LP has been started, the load circuit in the form of a resonant circuit is damped by the impedance of the now conductive discharge path between the electrodes E1, E2 of the fluorescent lamp LP. The impedance of the discharge path of the fluorescent lamp LP and its power consumption are dependent on the frequency of the current flowing through the lamp LP. This fact may be used to regulate the power consumption of the fluorescent lamp and thus also to regulate its brightness by the switching frequency of the semiconductor switches T1, T2 being varied in a corresponding manner by means of the control apparatus ST such that it is more or less removed from the resonant frequency of the damped resonant circuit.

In order to monitor the power consumption of the fluorescent lamp LP, the half-bridge current flowing through the resistor R2 is evaluated by means of two low-pass filters R3, C3 and R4, C4, since the half-bridge current flowing through the resistor R2 is identical to the current flowing through the fluorescent lamp LP over a half-cycle—namely when the switch T2 is closed. The first low-pass filter R3, C3 acting as the integrating element forms a voltage drop across the capacitor C3 which is averaged over several of the above-mentioned half-cycles, is proportional to the power consumption of the fluorescent lamp LP and is supplied to the input of the proportional-plus-integral controller IR as an actual value for a first control loop for regulating the brightness and regulating the power consumption of the fluorescent lamp. This actual value is compared with a predeterminable desired value SW in the proportional-plus-integral controller IR, said desired value SW being provided to the control apparatus ST from outside, for example by a dimming potentiometer or another dimming apparatus. The desired value SW represents the desired level of brightness or power level for the fluorescent lamp LP. The proportional-plus-integral controller IR determines, on the basis of the comparison of the desired value and the actual value, a first manipulated variable for controlling the switching frequency of the semiconductor switches T1, T2. The first manipulated variable is stored in the 14-bit data register S1 and read out by the driver switch TR which generates control signals for the base or gate electrode of the semiconductor switches T1, T2. The first control loop is designed to have time intervals of in each case 1 ms. This means that, after in each case 1 ms, a new actual value is fed to the proportional/integral regulator IR by means of the first low-pass filter R3, C3 and compared with the predeterminable desired value SW, and an updated first manipulated variable is written to the data register S1.

FIG. 2 shows a qualitative representation of the frequency dependence of the half-bridge current. In the case of the frequency f1, the fluorescent lamp is at its greatest level of brightness and the luminous flux is thus 100% of its nominal luminous flux. If the frequency is increased, the half-bridge current and thus also the power consumption and the luminous flux of the fluorescent lamp are reduced. In the frequency range $\Delta f$, which corresponds to a luminous flux of approximately 25% to 10% of the nominal luminous flux, the half-bridge current is extremely dependent on the frequency, with the result that unstable operating states can arise in this range.

In order to avoid the fluorescent lamp oscillating between a number of operating states, a second control loop is implemented by means of the second low-pass filter R4, C4, the differential-action controller DR, the data memory S2 and the data register S1, and this second control loop is passed through considerably more rapidly than the first control loop. Changes in the half-bridge current flowing through the resistor R2 are detected by means of the low-pass filter R4, C4 at time intervals of 100 μs. The differential-action controller DR carries out a comparison of the desired value and the actual value at time intervals of 100 μs, the in each case latest half-bridge current, evaluated by the low-pass filter R4, C4, being used as the actual value, and the actual value, stored temporarily in the data memory S2, of the in each case directly preceding time interval being used as the desired value. A second manipulated variable is generated by the differential-action controller DR on the basis of the comparison of the desired value and the actual value and is supplied to the 14-bit data register S1 and added to the first manipulated variable. The driver circuit TR uses the total of the two manipulated variables to determine signals for controlling the frequency of the semiconductor switches T1, T2. The half-bridge current and thus the power consumption and the brightness of the fluorescent lamp are stabilized at the desired value by means of the second control loop.

Since oscillations between different operating states are only to be expected in the abovementioned critical operating range of approximately 25% to 10% of the nominal luminous flux of the fluorescent lamp, the differential-action controller DR can be deactivated outside this critical operating range. This takes place by the actual value of the second control loop being multiplied, before the comparison of the desired value and the actual value, by a magnification factor K which is dependent on the chosen level of brightness, i.e. on the desired value SW of the first control loop. During operation of the fluorescent lamp LP at more than 25% of its nominal luminous flux, the magnification factor K can be reduced to zero.

The two controllers IR, DR are in the form of algorithms of a program-controlled microprocessor which is part of the control apparatus ST. In accordance with a further, particularly preferred exemplary embodiment of the invention, the first C3, R3 and second low-pass filters C4, R4 are replaced by in each case one digital filter, the first digital filter taking on the function of the first low-pass filter C3, R3 and the second digital filter taking on the function of the second low-pass filter C4, R4. The digital filters are formed as part of the control apparatus ST and in particular as part of the abovementioned program-controlled microprocessor. The two digital filters evaluate the current flowing through the bridge circuit, i.e. the voltage drop across the resistor R2. Their filter properties are determined by the software implemented in the microprocessor. In all other details, this exemplary embodiment corresponds to the first exemplary embodiment explained above.

What is claimed is:

1. A method for operating fluorescent lamps with aid of a ballast, which has an inverter having semiconductor switches, which are arranged in a bridge circuit, and having a control apparatus for the semiconductor switches, and at least one load circuit which is in a form of a resonant circuit, is connected to the inverter, and in which at least one fluorescent lamp is operated, the inverter applying a radiofrequency current to the at least one fluorescent lamp, and a power consumption of the at least one fluorescent lamp (LP) being set to a predetermined value by means of a first control loop by varying a frequency of the radiofrequency current, wherein, in addition, the power consumption of the at least one fluorescent lamp is stabilized at the predetermined value by means of a second control loop, which is passed through at shorter time intervals than the first control loop.

2. The method as claimed in claim 1, wherein for a purpose of carrying out the first control loop, a desired value which is set in terms of its magnitude is compared at predetermined time intervals with an actual value which is derived from the power consumption, averaged over time, of the at least one fluorescent lamp, and a first manipulated variable for the control apparatus is formed from this actual value, and in which, for a purpose of carrying out the second control loop at predetermined time intervals which are shorter than the time intervals for the first control loop, a change in the power consumption of the at least one fluorescent lamp is evaluated for a purpose of generating a second manipulated variable for the control apparatus, and the two manipulated variables are evaluated in order to generate control signals for regulating a switching frequency of the semiconductor switches.

3. The method as claimed in claim 2, wherein during the second control loop, a comparison of the desired value and the actual value is carried out, an actual value being derived from the current flowing through the bridge circuit at an end of each predetermined time interval and this actual value being compared with the actual value of the directly preceding time interval acting as the desired value, and the second manipulated variable for the control apparatus being generated therefrom.

4. The method as claimed in claim 3, wherein the actual value for the second control loop is derived from the current flowing through the bridge circuit by means of a second low-pass filter (R4, C4), a time constant of the second low-pass filter being smaller than a time constant of the first low-pass filter.

5. The method as claimed in claim 2, wherein for a purpose of carrying out the first control loop, a desired value which is set in terms of its magnitude is compared at predetermined time intervals with an actual value which is derived from the current flowing through the bridge circuit, and in which, for a purpose of carrying out the second control loop at predetermined time intervals which are shorter than the time intervals for the first control loop, a change in the current flowing through the bridge circuit is evaluated.

6. The method as claimed in claim 5, wherein during the second control loop, a comparison of the desired value and the actual value is carried out, an actual value being derived from the current flowing through the bridge circuit at the end of each predetermined time interval and this actual value being compared with the actual value of the directly preceding time interval acting as the desired value, and the second manipulated variable for the control apparatus being generated therefrom.

7. The method as claimed in claim 6, wherein the actual value for the second control loop is derived from the current flowing through the bridge circuit by means of a second low-pass filter, a time constant of the second low-pass filter being smaller than a time constant of the first low-pass filter.

8. The method as claimed in claim 1, wherein for a purpose of carrying out the first control loop, a desired value which is set in terms of its magnitude is compared at predetermined time intervals with an actual value which is derived from the current flowing through the bridge circuit, and in which, for a purpose of carrying out the second control loop at predetermined time intervals which are shorter than the time intervals for the first control loop, a change in the current flowing through the bridge circuit is evaluated.

9. The method as claimed in claim 8, wherein the actual value for the first control loop is derived from the current flowing through the bridge circuit by means of a first low-pass filter.

10. The method as claimed in claim 9, wherein the actual value for the second control loop is derived from the current flowing through the bridge circuit by means of a second low-pass filter, a time constant of the second low-pass filter being smaller than a time constant of the first low-pass filter.

11. The method as claimed in claim 8, wherein the actual value for the first control loop is derived from the current flowing through the bridge circuit by means of a first digital filter.

12. The method as claimed in claim 11, wherein the actual value for the second control loop is derived from the current flowing through the bridge circuit by means of a second low-pass filter (R4, C4), a time constant of the second low-pass filter being smaller than a time constant of the first low-pass filter.

13. The method as claimed in claim 8, wherein during the second control loop, a comparison of the desired value and the actual value is carried out, an actual value being derived from the current flowing through the bridge circuit at the end of each predetermined time interval and this actual value being compared with the actual value of the directly preceding time interval acting as the desired value, and the second manipulated variable for the control apparatus being generated therefrom.

14. The method as claimed in claim 13, wherein the actual value for the second control loop is derived from the current flowing through the bridge circuit by means of a second low-pass filter, a time constant of the second low-pass filter being smaller than a time constant of the first low-pass filter.

15. The method as claimed in claim 1, wherein predetermined time intervals of the first control loop are from 1 ms to 2 ms long.

16. The method as claimed in claim 1, wherein predetermined time intervals of the second control loop are from 50 $\mu$s to 200 $\mu$s long.

* * * * *